US008091557B2

(12) United States Patent
Cortesi

(10) Patent No.: US 8,091,557 B2
(45) Date of Patent: Jan. 10, 2012

(54) DEVICE TO LIGHT AND EXTINGUISH A CIGARETTE WITH RECOVERY OF THE CIGARETTE

(76) Inventor: Pierpaolo Cortesi, Bologna (IT)

( * ) Notice: Subject to any disclaimer, the term of this patent is extended or adjusted under 35 U.S.C. 154(b) by 0 days.

(21) Appl. No.: 12/686,739

(22) Filed: Jan. 13, 2010

(65) Prior Publication Data

US 2010/0108080 A1 May 6, 2010

Related U.S. Application Data

(63) Continuation of application No. PCT/IB2008/001959, filed on Jul. 25, 2008.

(51) Int. Cl.
*A24F 13/24* (2006.01)
*A24F 13/18* (2006.01)

(52) U.S. Cl. ..... 131/249; 131/248; 131/250; 131/256

(58) Field of Classification Search ..... 131/256, 131/248, 249, 250
See application file for complete search history.

(56) References Cited

U.S. PATENT DOCUMENTS

| | | | |
|---|---|---|---|
| 4,819,666 | A | 4/1989 | Turver |
| 4,897,033 | A | 1/1990 | Yang |
| 5,181,528 | A | 1/1993 | Chen et al. |
| 5,605,226 | A | 2/1997 | Heinlein |
| 5,673,709 | A | 10/1997 | Brothers |
| 5,934,894 | A | 8/1999 | Cigler |
| 2004/0219468 | A1 | 11/2004 | Hanosek et al. |
| 2006/0275726 | A1 | 12/2006 | Koropsak |

FOREIGN PATENT DOCUMENTS

| | | | |
|---|---|---|---|
| FR | 2359377 | A | 2/1978 |
| FR | 2684523 | A | 6/1993 |
| JP | 2000-189145 | * | 7/2000 |
| WO | WO2005/089577 | A | 9/2005 |
| WO | WO2007/005488 | A | 1/2007 |
| WO | WO 2007/008469 | * | 1/2007 |

OTHER PUBLICATIONS

FR 2836017 English Abstract/Clipped Image.*
FR 2836017 English Abstract/Clipped Image, Publication Date: Aug. 2003.*

* cited by examiner

*Primary Examiner* — Richard Crispino
*Assistant Examiner* — Dionne Walls Mayes
(74) *Attorney, Agent, or Firm* — William J. Sapone; Coleman Sudol Sapone P.C.

(57) ABSTRACT

The device consists of a first container body (1) with a lighter for a cigarette and a housing seat (2) having a size suitable to house a cigarette and it further has a container body (8) to extinguish the cigarette.

4 Claims, 2 Drawing Sheets

II-II

I-I

DEVICE TO LIGHT AND EXTINGUISH A CIGARETTE WITH RECOVERY OF THE CIGARETTE

CROSS REFERENCE TO RELATED APPLICATIONS

This application is a continuation of PCT International patent application no. PCT/IB2008/001959, filed Jul. 25, 2008.

BACKGROUND

In the field of cigarette lighters are known portable lighters. In the known art, the lighters principally consist of a fuel tank, an igniter and auxiliary parts.

An object of the present invention is to provide a new and original device able to perfectly extinguish and eventually recover a lighted cigarette which was not completely smoked to permit smoking the same cigarette a second time.

It is known that in a lot of places it is not possible to smoke and before entering these places, a cigarette must be extinguished, even if the cigarette was lighted for a short time, requiring throwing away a cigarette, sometime also not completely extinguished, with most of the tobacco not used.

This situation results in many cases where peoples are obliged to throw away cigarettes just lighted and only partially smoked, which is also a source of danger from the fire risk. It is also a waste and financial burden on the smoker.

In the previous art are known different devices which simply cut the part near to the lighted part of the cigarette. However, these known devices are cumbersome and they are another object that the smoker must have with him.

Moreover, with these known devices, the cigarette cutting is not always perfect and there remains the bad smell of burning. Thus, the known devices which do not accomplish a perfect cutting create the possibility that parts of the cigarette can cause a new lighting of the same cigarette, with dangerous consequences, since the cut cigarette is generally put into a packet of cigarettes, with parts that can easily burn, or the cut cigarette is placed in a pocket of the smoker's clothing, with significant danger in case the cigarette has not been completely extinguished.

The inventive device permits, instead, in addition to extinguishing and cutting a lighted cigarette, also providing a housing and a suitable seat inside the new device, with a high safety standard, such as to make impossible a new lighting of the cigarette. The containment seat for the cut cigarette provides an upper closing able to block the arrival of oxygen to the cut cigarette.

The inventive device, moreover, is realized with sizes suitable to permit the device to be housed in cigarette packet in which there is space for at least two cigarettes or outside the same.

Aims and characteristics of the inventive device are better to be noted from the following detailed description together with the enclosed drawings showing in an indicative and not limiting way the invention.

BRIEF DESCRIPTION OF THE DRAWINGS

In particular.

DETAILED DESCRIPTION OF THE INVENTION

Figure 1:
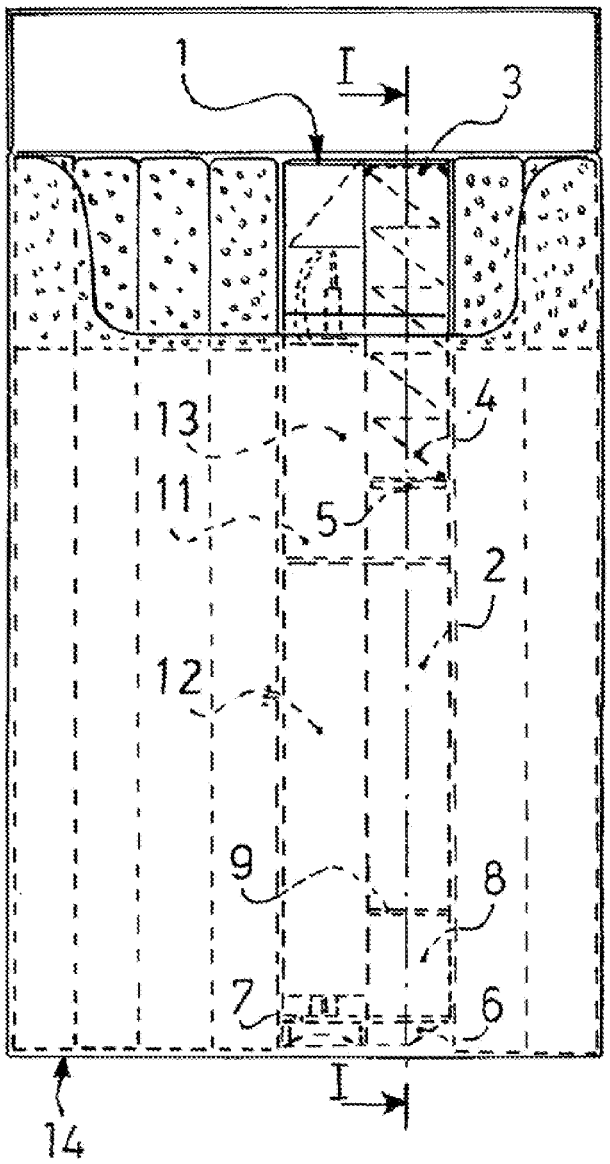
FIG. 1 is frontal view of the inventive device housing located in a packet of cigarettes.
Figure 2:
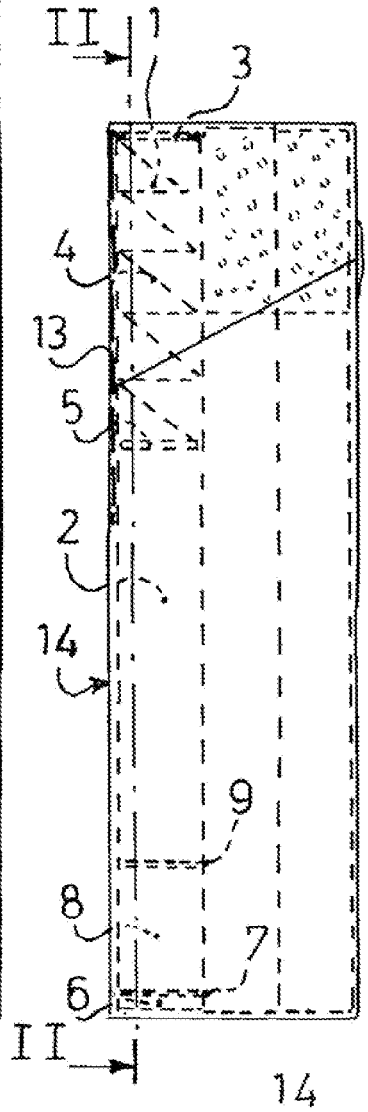
FIG. 2 is frontal view of the inventive device housing located in a packet of cigarettes.
Figures 3, 4, 5, 6:
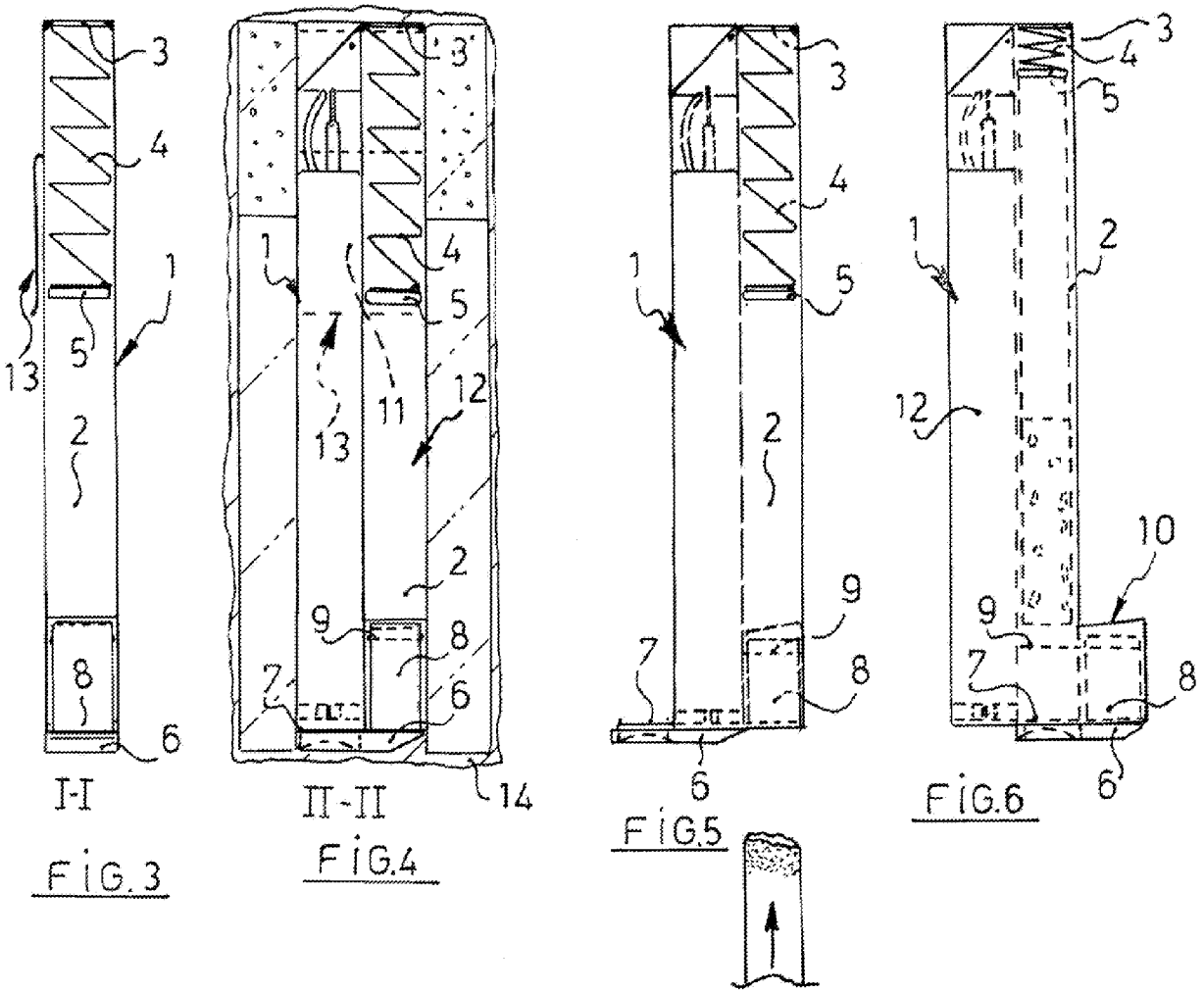
FIGS. 3, 4, 5 and 6 are section views showing the inventive device.

In particular, FIGS. 3 and 4 show the device in when not in use. FIG. 5 shows the device when inserting and extinguishing the cigarette. FIG. 6 shows the device in the recovery step showing the cut cigarette inside the housing seat before closing the cylindrical container. The closed bottom is provided for performing the extinguishing and to hold the end part of the cigarette during the cutting.

The inventive device consists of a first container body 1 into which is housed a suitable recharging lighter for a cigarette. Inside this first container body 1 is present a housing seat 2 having an inside size suitable for containing a cigarette.

At the bottom 3 of the housing seat 2 is connected a spring 4 with a small resistance to compression. At the other end of the spring 4 which is stable is placed a plate 5. At the opposite end of the bottom 3 of the housing seat, i.e. in the opening part of the housing seat 2, is provided a blade 6, placed on guides 7 and movable to provide an opening so as to insert a lighted cigarette inside a second container body 8. Also the blade 6 moves laterally to the frame of the first container body 1 by means of guides 9 that permit its movement but not its coming out.

The second container body 8 is made of an anti-fire material and it is movable to permit the insertion of the cut cigarette into the housing seat 2. Said second container body 8 has an inside sized larger than the cigarette diameter and an outside sized equal to an under part of the housing seat 2. Moreover, an outside bottom 10 of the second container body 8 may be slightly inclined to help the insertion of the cut cigarette into the housing seat 2 and to permit the compression of the spring 4 when the second container body 8 is closed against the first container body 1.

The tightening at an end run of the guides 7 and 9 permits the second containment body 8 and the blade 6 to remain inside the first container body 1. The pulling out and the moving of the blade 6 and the second containment body 8 are actuated by a manual push action, determined prevalently with the thumb, toward the outside part of the first container body 1.

In use, the inventive device provides for lighting of the cigarette with a conventional lighter, inserted in the first container body 1. In the case that the cigarette must be extinguished, the lighted part of the cigarette is inserted in the second container body 8 and it is cut by the blade 6 previously opened to permit the insertion of the lighted end of the cigarette inside the second container body 8.

Actuating the cut is accomplished by moving the blade 6 placed as a horizontal guillotine, with the motion of the blade driven with a finger. Thus, the burning part is eliminated inside the second container 8. Then this second container body 8 is moved toward the outside part of the first container 1 so as to permit the insertion of the cut cigarette in the housing seat 2 through the back hole present in the inside part of the blade 6 and with sizes of said hole being suitable for the passage of the cigarette inside the housing seat 2.

In the case of a cut cigarette of longer length, as for example for the cigarettes known as 100's, cigars or similar, the outside bottom 10 is slightly inclined to help with the compression of the spring 4 closing again the second container body 8.

To take out the cut cigarette, the second container body 8 and the blade 6 are moved so to provide the opening in the housing seat 2. The release action of the spring 4, previously compressed in the insertion, helps with the coming out of the cut cigarette.

In another embodiment, also part of the present invention, the inventive device is provided without the spring and the plate but instead has bigger inside spaces for the housing seat so as to avoid the cut cigarette being jammed inside the housing seat 2.

In a further embodiment, also part of the present invention, the inventive device is made for a stable disposition, i.e. it is created like an ash-try, with possibility to cut the cigarette or the cigar inside the second containment body 8 with cutting actuated by means of the blade 6 and recovery of the remaining part of the cigarette or of the cigar.

All the technical details can be replaced with other ones equivalent without varying from the present invention. The materials and the sizes may be of every kind, as necessitated by the intended use. Moreover, it is possible, if requested, to provide a part 11 on an outside face 12 of the first container body 1 or on an upper end outside, a tongue 13 for connection with the cigarette packet 14 and for advertising.

The invention claimed is:

1. A device for lighting and extinguishing a cigarette and for recovery of an unburned portion of the cigarette, the device having a first container body which houses a lighter for a cigarette, the device further comprising:

a cigarette housing located inside said first container body, said cigarette housing having a bottom at a first end thereof, and an opening part at an opposite end thereof, the cigarette housing having an inside suitable for containing the unburned portion of the cigarette therein;

a second container movably disposed in the opening part of the cigarette housing, and being movable laterally with respect to a frame of said first container body by means of a guide, such that the second container body is movable out of the cigarette housing, exposing an opening leading into the cigarette container to permit the unburned portion of the cut cigarette to enter into the cigarette housing;

a blade provided adjacent an end of the first container part and the opening part of the cigarette housing and placed on guides so as to be movable with respect to the opening part of the cigarette housing when the second container is disposed therein, such that a burning part of a cigarette is insertable into the second container body, the blade being movable with respect to the second container body to cut off the burning part of the cigarette disposed in said second container body and to close off the end of the second container part to contain the burning part of the cigarette inside the second container body, the blade having a hole in a back portion thereof which is alignable with the opening leading into the cigarette housing for allowing the passage of the cut cigarette into the cigarette housing;

the second container body and blade being movable laterally with respect to a frame of said first container body by means of the guide to expose the opening leading into the cigarette housing to permit the unburned portion of the cut cigarette to pass through the hole in the back portion of the blade and enter into the cigarette housing, the second container body and blade thereafter moving back to close off the opening part of the cigarette housing.

2. The device according to claim 1, further comprising a spring located at the bottom of the cigarette housing, a plate fixedly placed at an end of the spring for biasing the unburned portion of the cigarette located therein towards the opening part.

3. The device according to claim 2 wherein an outside bottom wall of the second container body is inclined to help the insertion of the cut cigarette into the cigarette housing and to permit the compression of the spring when the second container body is moved back into the opening part of the cigarette housing.

4. The device according to claim 1, wherein the second container body is made of an anti-fire material and has an inside sized larger than a diameter of the cigarette and an outside sized to fit within the opening part of the cigarette housing.

* * * * *